US008655160B2

(12) United States Patent
Linow et al.

(10) Patent No.: US 8,655,160 B2
(45) Date of Patent: Feb. 18, 2014

(54) CFC RADIANT HEATER

(75) Inventors: Sven Linow, Darmstadt (DE); Stefan Fuchs, Niedernberg (DE); Siegfried Grob, Maintal (DE)

(73) Assignee: Heraeus Noblelight GmbH, Hanau (DE)

( * ) Notice: Subject to any disclaimer, the term of this patent is extended or adjusted under 35 U.S.C. 154(b) by 2078 days.

(21) Appl. No.: 11/291,455

(22) Filed: Dec. 1, 2005

(65) Prior Publication Data

US 2006/0115244 A1 Jun. 1, 2006

(30) Foreign Application Priority Data

Dec. 1, 2004 (DE) ..... 10 2004 058 077

(51) Int. Cl.
*F24C 7/00* (2006.01)
*H05B 3/00* (2006.01)

(52) U.S. Cl.
USPC ..... 392/407; 392/411

(58) Field of Classification Search
USPC ..... 392/407, 435, 436, 437; 219/541, 544, 219/548, 552
See application file for complete search history.

(56) References Cited

U.S. PATENT DOCUMENTS 6,584,279 B2 6/2003 Seko et al.
6,949,727 B2 * 9/2005 Park ..... 219/548

FOREIGN PATENT DOCUMENTS

| | | | |
|---|---|---|---|
| DE | 44 19 285 | A1 | 12/1995 |
| DE | 44 38 871 | A1 | 5/1996 |
| EP | 0 881 858 | A2 | 12/1998 |
| EP | 0 899 777 | B1 | 9/2004 |
| JP | 01-211887 | A | 8/1989 |
| JP | 6260430 | A | 9/1994 |
| JP | 7-161725 | A | 6/1995 |
| JP | 8315965 | A | 11/1996 |

* cited by examiner

*Primary Examiner* — Thor Campbell
(74) *Attorney, Agent, or Firm* — Panitch Schwarze Belisario & Nadel LLP

(57) ABSTRACT

An IR radiant heater has at least one planar carbon heating element (1) arranged in a housing, which is transparent or at least partially transparent to IR radiation. At least one carbon heating element (1) is a carbon fiber-reinforced carbon (CFC) web arranged in a plane and arranged between two plates (2, 3), of which at least one is transparent or partially transparent.

10 Claims, 7 Drawing Sheets

CFC RADIANT HEATER

BACKGROUND OF THE INVENTION

The present invention relates to an IR radiant heater having at least one two-dimensional (planar) carbon filament in a housing that is transparent or at least partially transparent to IR radiation.

Such an IR radiator is realized according to European published patent application No. EP 0 881 858 A2 with a single filament arranged in a round tube and in German published patent applications Nos. DE 44 38 871 A1 and DE 44 19 285 A1 with several carbon filaments arranged next to each other. The carbon materials used there consist of parallel carbon fibers, which are connected by resin. These structures are carbonized and graphitized before installation in the radiator.

The radiator disclosed in EP 0 881 858 is not suitable for uniform two-dimensional radiation. DE 44 38 871 and DE 44 19 285 relate to the use of comparable filaments, but with the goal of achieving two-dimensional (2D) radiation.

However, the carbon filaments disclosed in these documents cannot be assembled into arbitrary two-dimensional heating elements, because the material can have only an elongated and constant width arrangement. The arrangements shown in DE 44 38 871 can realize this configuration, but neither uniform radiation intensities, nor such bent or round shapes, or even 3D shaped structures, can be realized.

Even the arrangement shown in DE 44 38 871, FIG. 5*a* exhibits a considerable variation in temperature, and thus of the radiated output per unit of length in the bands located at the edge, due to the different lengths of the different fibers. Arrangements with a plurality of narrow bands, like those in DE 44 19 285, require a plurality of complicated and expensive contacts for the individual bands relative to each other.

However, such carbon bands cannot be arranged in arbitrary two-dimensional patterns, because the bands only permit minimal deviations from a parallel arrangement. Bands can be arbitrarily formed perpendicular to their two-dimensional configuration. However, such arrangements lack the two-dimensional character of a radiating surface.

The present invention also relates to the use of CFC material for radiant heaters.

Japanese published patent application No. JP 7-161725 A1 describes cutting out a heating pattern from planar material, wherein silicon carbide (SiC) is used. The SiC heating element there is located in an open housing made of quartz glass, on which a graphite disk (see FIG. 1, No. 8) is placed on the side used for the heat treatment. The graphite disk is heated by the SiC heater and then secondarily warms the material. Such heating elements made of SiC or graphite are brittle and rigid, so that they are very sensitive to fracture. The heating element is also electrically contacted rigidly by screws, so that heat expansion introduces there an additional risk of fracture. To guarantee sufficient mechanical strength in such heating elements, these must be constructed very large. Due to the low electrical resistance present there, very high currents flow during operation at low voltages. This requires complicated power-grid supply circuits and the electrical supply lines can be guided into a vacuum-tight quartz body only with difficulty. For this reason, the quartz glass housing there also has an open shape.

European Patent No. EP 0 899 777 B1 describes a carbon heating device with a heating device member made of carbon fiber bundles extending in a longitudinal direction and interwoven with each other, such as a band or wire shape. These interwoven carbon fiber bundles are expressly not by graphite expressly not converted into CFC by graphite. Thus, these bundles remain very flexible, and the risk of brittle fracture is avoided. The described wire-shaped or band-shaped heating device elements have a high electrical resistance, so that the heating device can be designed to operate at common voltages. Due to the very low number of fibers in the band, however, even at maximum output only a rather small current of a few amperes flows, so that overall the electrical output of such a unit turns out to be rather small at 30 kW/m$^2$.

The heating device element is laid in channels, which have been milled in a first quartz plate. Then the heating device is sealed by a second quartz plate, which is laid on the first plate and connected to it. The connection is realized by placing a weight of 10 kg and a heating process, in which the entire device is heated to 1450° C. for 3 hr. The resulting connection of the two quartz plates is not a continuous weld and, after long-term operation, gaps can appear due to mechanical and-thermal loads.

According to U.S. Pat. No. 6,584,279 B2, an IR radiator with an electrical output of up to 28 kW/m$^2$ is obtained with braided carbon fibers.

In braking technology, carbon fiber-reinforced carbon (CFC) disks made of CFC material or Si-impregnated CFC are used.

BRIEF SUMMARY OF THE INVENTION

The goal of the invention is to develop an IR radiator, which can be operated at typical power-grid voltages, at the same time has high output and long service life and permits a large degree of flexibility in possible configurations in terms of the required shapes of the process.

According to the invention, it was surprisingly discovered that with the use of complex shape filaments for carbon radiators, which were cut from CFC sheets, surface outputs of over 30 kW/m$^2$, in particular over 100 kW/m$^2$, can be produced. It was further surprisingly discovered that when these filaments are placed in a housing, which comprises opaque quartz glass on the bottom side and on the top side clear quartz glass that is sandblasted or frosted except at the surface, IR radiation is radiated primarily only from the top side. The hot quartz glass itself does radiate in the range of long-range infrared above 5 μm and the radiated output in this wavelength range is independent of the quartz material used or the surface. However, only this secondary portion of the radiation appears at the bottom side of the device according to the invention.

By selecting a suitable CFC material of high specific electrical resistance, as produced, for example, by using a thread that was produced from a plurality of short fiber sections and then was interwoven into a web, a suitable specific electrical resistance can be set. Such webs also remain flexible and tear-resistant after impregnation and conversion into CFC. Filaments of complex shapes cut from CFC sheets also remain flexible and tear-resistant.

Because the thickness of the material is low, preferably <about 1 mm and particularly preferred <about 0.3 mm, an electrical resistance of the filaments, which enables the operation at typical operating voltages (208 V, 230 V, 400 V, 480 V), is also achieved. Typical current leadthroughs for IR radiators permit approximately 25 A, so that considerable outputs per filament can be realized.

According to the invention, it was surprisingly discovered that in flat radiant heaters with patterns made of a CFC web, outputs of over 30 kW/m$^2$, particularly over 100 kW, can be achieved, and radiators with an output of about 8-12 kW can be produced. The planar radiators can radiate on one side, if a planar carbon pattern is arranged between two surfaces, of which one is opaque and the other is clear. The invention can also be realized with several CFC webs.

In this manner, heating technology is provided, which is of the highest standard for super-clean applications, such as those required in the semiconductor industry.

In preferred embodiments of the invention, planar quartz glass elements, or plates, of the housing are welded, adhered or soldered to each other to form a housing. Preferably, at least one of these plates is reflective to IR or at least partially transparent to IR. The housing can be manufactured from a high-purity material, for example quartz glass. The CFC heating filament can be arranged in the housing on holders, wherein the shape of the holders is preferably selected so that the contact surface is kept small, ideally limited to a line. Suitable holders comprise, for example, rods made of quartz glass, aluminum oxide, or other non-conductive material with a high melting point, and ideally are formed as bodies with a sharp edge on which the filament lies.

Preferably, the output of the radiant heater equals more than about 30 kW/m$^2$, particularly about 50 to 250 kW/m$^2$, for radiant heaters with a service life of about 5000 to 10,000 hours.

Another preferred embodiment consists in radiant heaters with an output of over about 200 kW/m$^2$, particularly over about 250 kW/m$^2$, for short-lived radiators.

The particularly preferred field of application is a long-lived radiant heater with an output of about 100 to 200 kW/m$^2$.

In the preferred shape of a surface radiator, two spatial dimensions are more pronounced by a factor of at least about five, and preferably by about one to two orders of magnitude, than the third dimension. For example, as shown in FIG. 6, the radiant heater housing may have spatial dimensions X, Y, and Z, which are orthogonal with respect to each other. The housing is preferably more pronounced in the X and Y spatial dimensions than in the Z spatial dimension at least by a factor of about five, and more preferably by at about one to two orders of magnitude. Such spatial dimensions have proven effective to evacuate the housing or to fill it with inert gas.

The electrical contact of the filament is realized preferably by clips made of molybdenum, wherein additional layers made of suitable carbon materials between the filament and the clip provide an ideal electrical and mechanical contact.

Preferred CFC patterns are disk-shaped, meander-shaped, spiral-shaped, omega-shaped, a folded-in omega shape, or circular with a recess. The CFC pattern can be cut particularly cleanly from a CFC sheet with the necessary accuracy and by careful handling of the material with a laser or water jet.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1A:
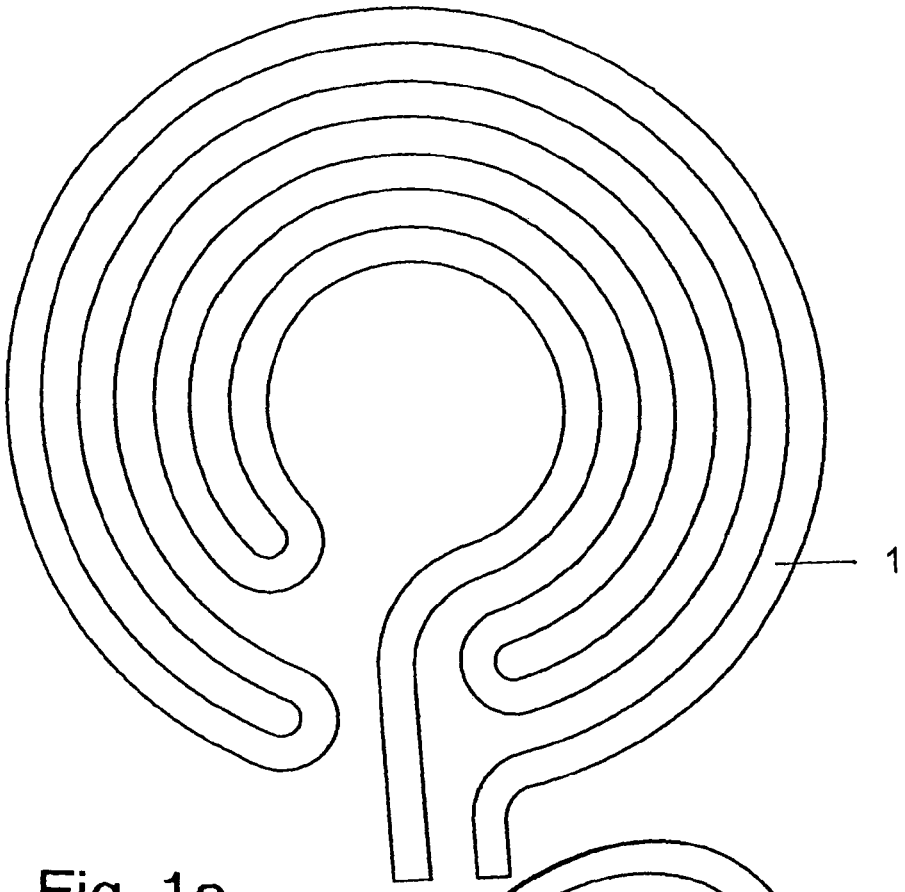
FIG. 1 a is a plan view of a heating element 1.
FIG. 1*b* is a perspective view of the heating element 1.
Figure 1B:
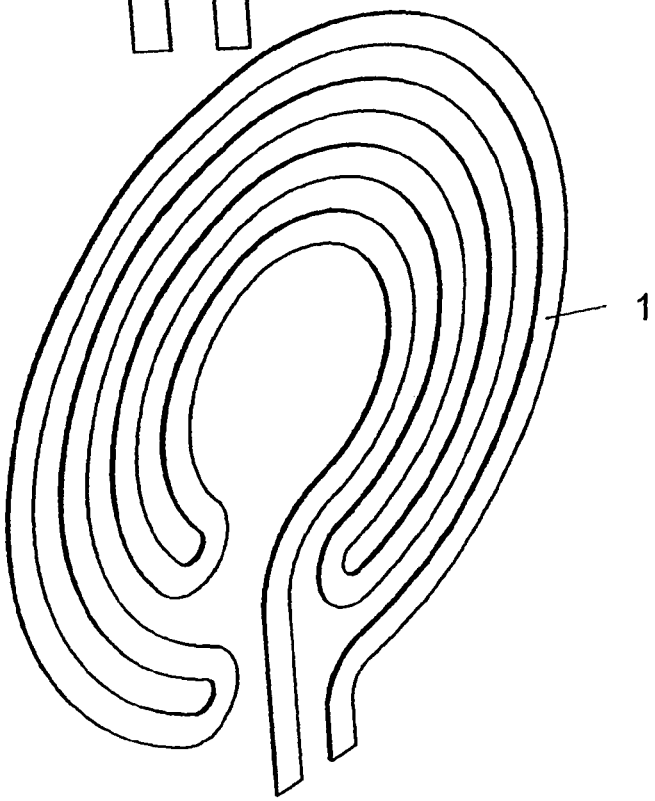

A heating element according to FIG. 1*a* or 1*b* is cut out from a sheet made of CFC material.

Figure 2A:
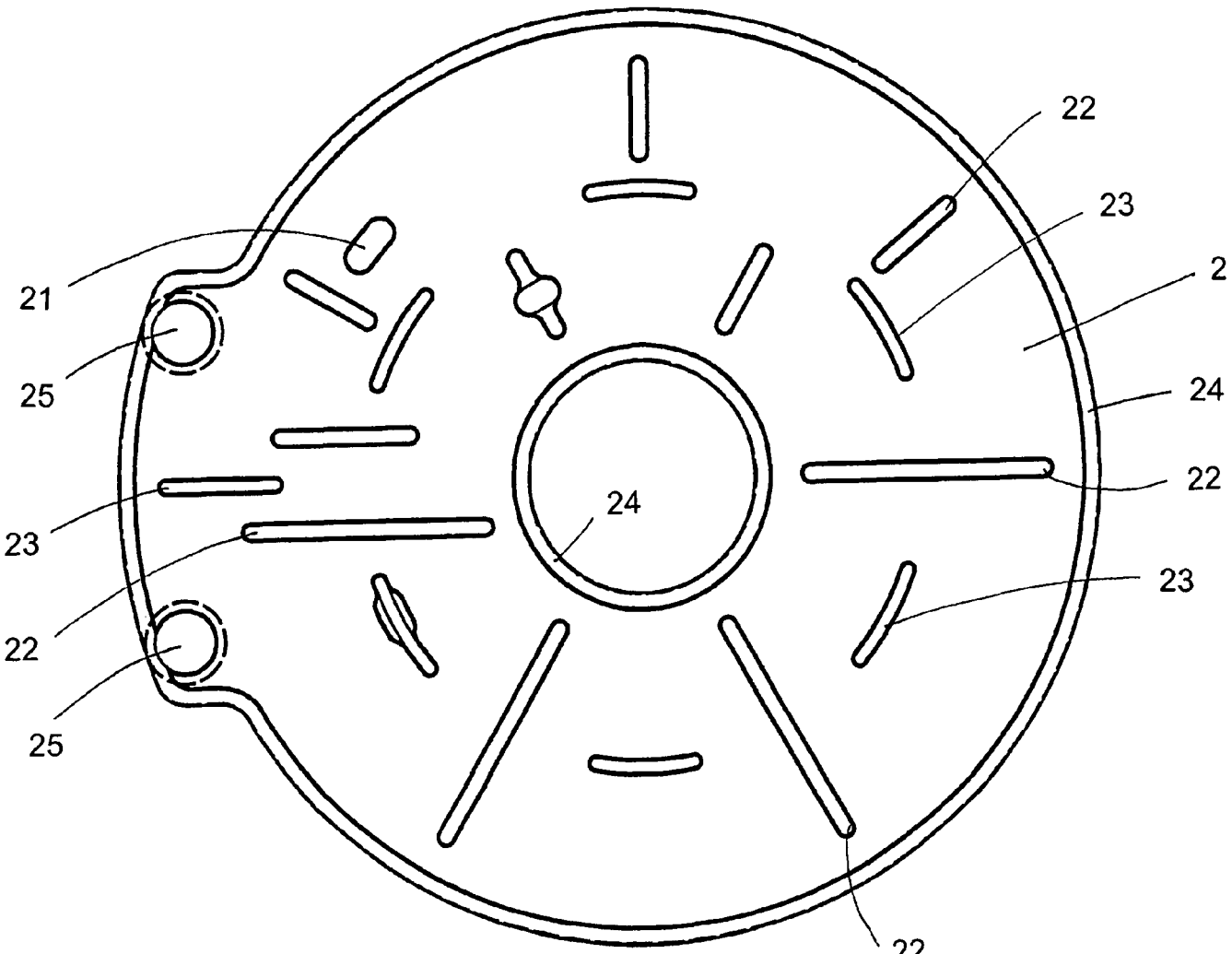
FIG. 2*a* is a plan view of a base plate 2.
Figure 2B:
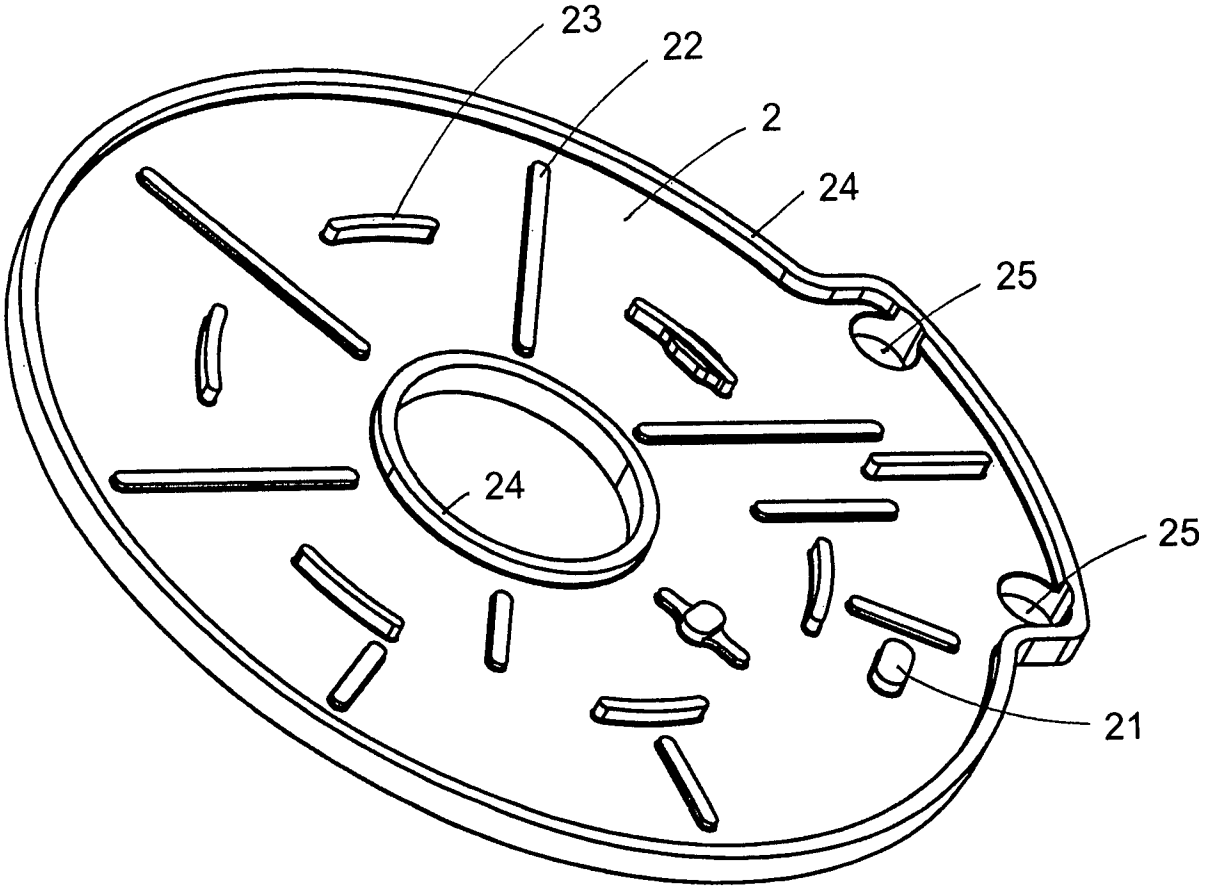
FIG. 2*b* is a perspective view of the base plate 2.

The base plate 2 according to FIG. 2*a* or 2*b* is produced from opaque quartz glass, preferably a quartz glass having a diffuse reflection of greater than about 90% and more preferably greater than about 95%. In its surface, there are contact pieces 22 for the heating band 1, spacers 23, which are welded to the cover plate, and positioning pins 21 for fixing the heating band 1. An edge 24 for welding to the cover plate is provided peripherally on the outside. Furthermore, two bore holes 25 are provided for the electrical contacts.

Figure 3A:
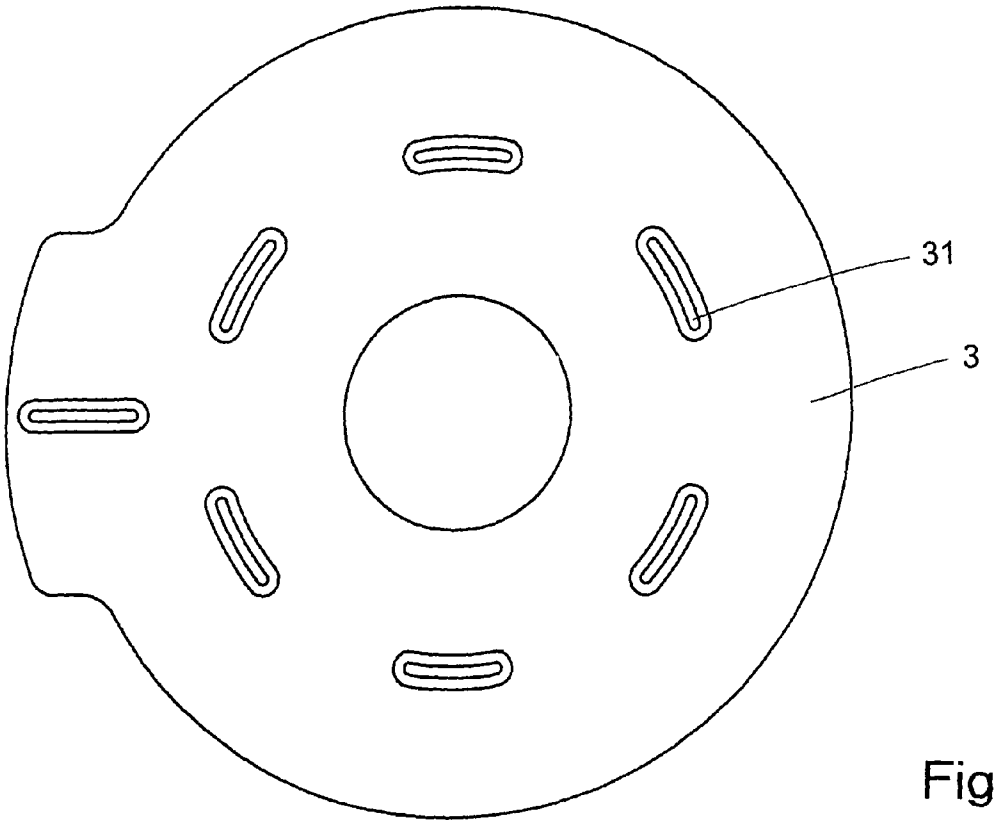
FIG. 3*a* is a plan view of a cover plate 3.
Figure 3B:
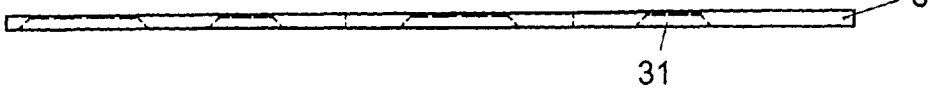
FIG. 3*b* is a side view of the cover plate 3.

FIGS. 3*a* and 3*b* show a cover plate 3 made of quartz glass with counter-bored openings 31 for welding the cover plate to the spacers 23 of the base plate 2.

Figure 4:
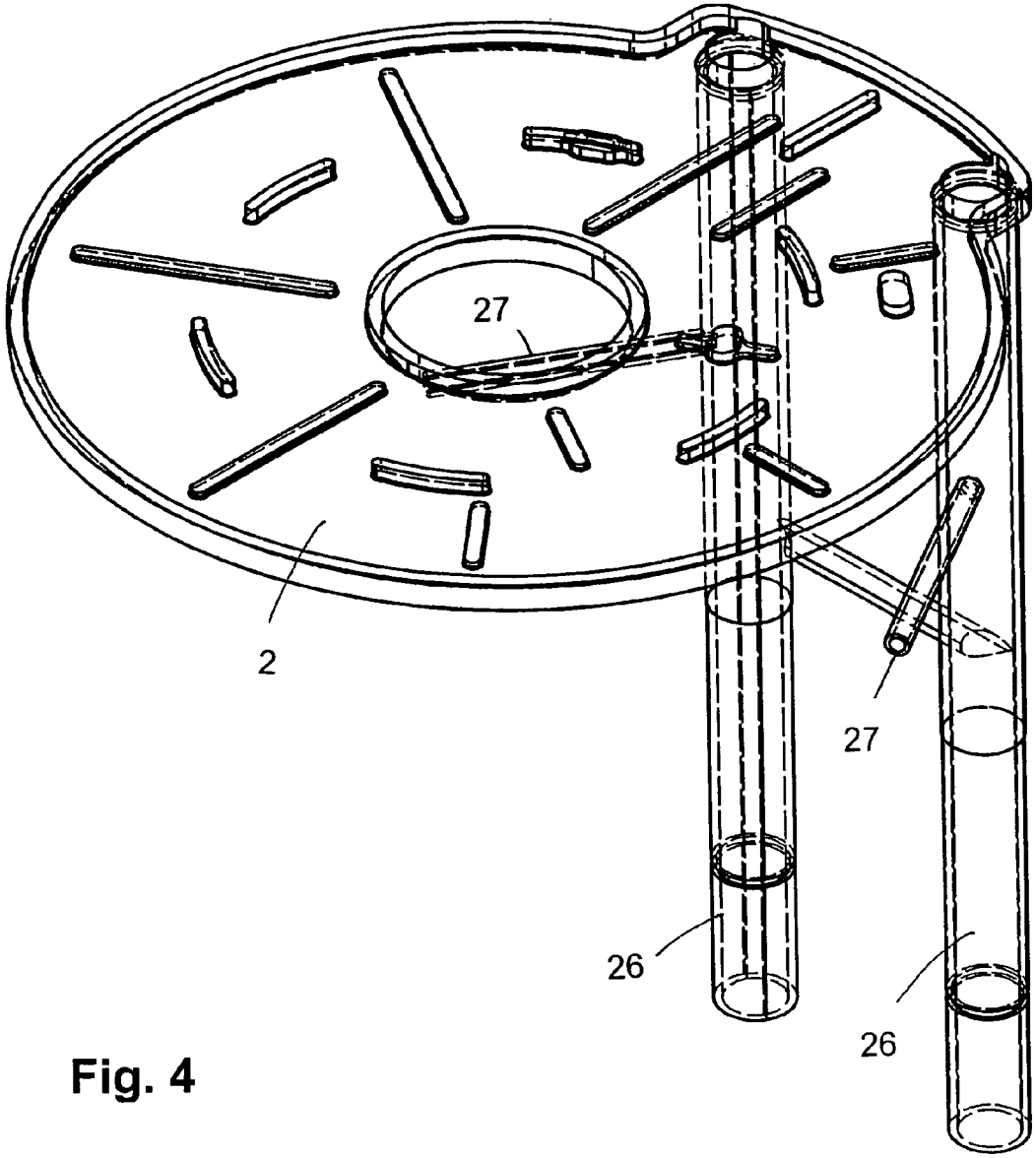
FIG. 4 is a perspective view of the base plate 2 with the mounted supply lines of the electrical contacts 26 and the mounted pump nozzles 27.

In FIG. 4, the base plate 2 is equipped with mounted supply lines of the electrical contacts 26 and the mounted pump nozzles 27.

Figure 5:
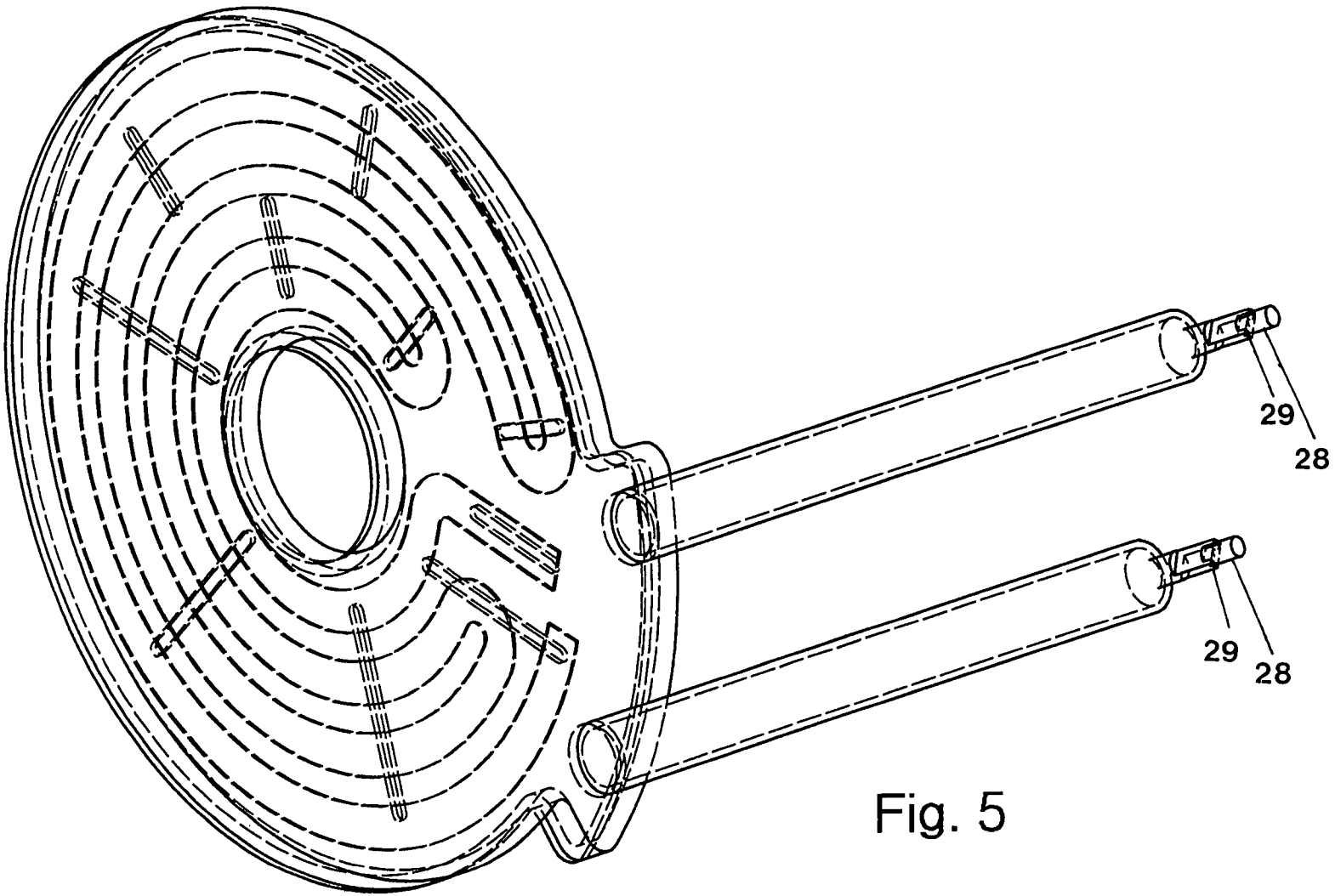
FIG. 5 is an overall perspective view of the device from below.
Figure 6:
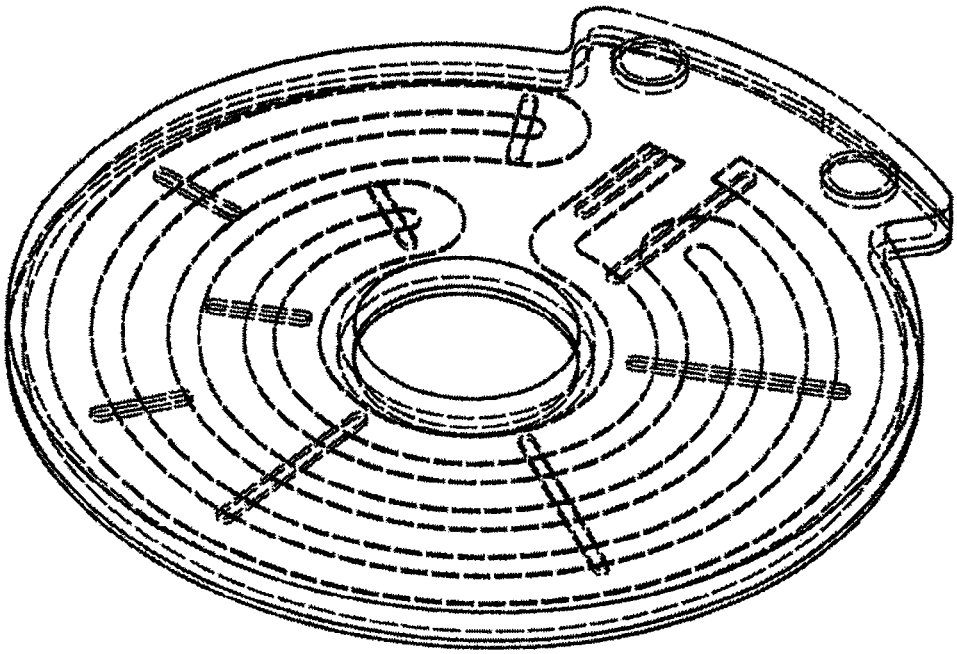
FIG. 6 is a perspective view of the radiant heater housing having a heating element therein, with respect to three spatial dimensions.
Figure 6:
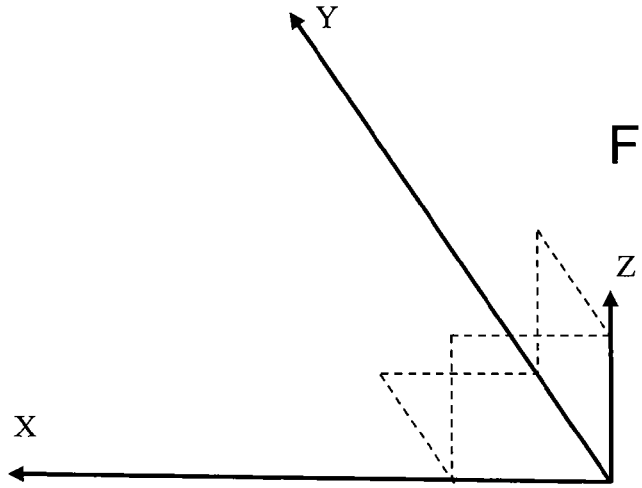

In FIG. 5, the electrical supply lines 28 and socket 29 are also attached.

The radiant heater according to FIG. 5 has a CFC heating element 1 (FIGS. 1*a* and 1*b*), which fills out the entire surface to be heated in a meander pattern. Underneath the ends of the filament 1, two tubes made of quartz glass for receiving the electrical contacts 26 and the current leadthroughs contact the base plate 2 (FIGS. 2*a*/2*b*) made of quartz glass (OM-100 according to Heraeus brochures from 2002). The front side 3 is a clear quartz glass panel 3. The disks 2 and 3 are sealed to form a tight space, which is evacuated by the tubes for the current supply lines. In this configuration, the carbon band 1 can be heated to approximately 1300° C. at an output of 200 kW/m$^2$.

In a simple configuration according to FIGS. 2*a* and 2*b*, the opaque disk is formed as a base plate 2, on which spacers 23 are arranged. The base plate 2 is bounded by an inner and an outer ring 24. The CFC pattern 1 lies loosely on the contact pieces 22, and a clear quartz glass plate 3 forms a seal with the rings.

In FIG. 2, the current leadthroughs are located outside the circular radiation unit and require a deviation from the disk or ring shape for the glass plates 2, 3 and rings. In this configuration, the carbon band 1 can be heated to approximately 1300° C. at an output of 200 kW/m$^2$.

For ultra-high purity applications, the CFC pattern 1 is cut from a CFC surface with a laser. The spacers 23 and also the rings and the quartz glass plates 2, 3 consist of ultra-high purity quartz glass, so that, in addition to the metallic current supply lines and the molybdenum retaining clips connecting the web ends to the current leadthroughs, only high-purity quartz glass is used as the radiator housing and high-purity carbon is used as the radiation source 1.

PRODUCTION EXAMPLE

An opaque quartz glass plate 2 of sufficient thickness is cut into the necessary shape for the bottom side 2, then the recesses are milled and ground. In this way, the edge 24 and the spacers 23 remain at their original height and the contact pieces 22 for the filament stand at a lower height. Finally, the openings, in which the tubes for the electric contacting and the current leadthrough are placed, are bored. Edges are smoothed or fire-polished, if necessary.

Then tubes made of quartz glass are set on the bore holes, in each of which tubes a current leadthrough is arranged. Additionally, nozzles 27 for establishing a vacuum and for introducing flushing gas are located at these tubes.

The cover plate 3 for the top side is cut and ground from pure quartz glass. In particular, openings 31 for later welding of the plate to the spacers 23 of the opaque plate 2 are formed.

The heating element 1 is cut from a CFC sheet material by a water jet and then coated with pyrocarbon in a reactor.

Current leadthroughs are produced in the shape of crimped sections. A molybdenum pin is located at the inner end of the current leadthrough. The clamp for receiving the heating element 1 is attached to this pin.

The current leadthrough is welded to the tube of the current leadthrough, so that the clamps for receiving the filament are already located in the later plane of the filament. Then, the band is laid on the bottom side, and the band ends are connected in a clamped manner to the current leadthrough by the molybdenum sheet retaining clip. Here, for mechanical protection and for improving the electrical contact, additional small graphite layers are deposited.

The cover plate 3 is placed and the resulting interior is flushed with argon, so that during the welding process, water vapor or oxygen cannot oxidize the carbon or the molybdenum.

Then, the two quartz elements 2, 3 are welded to each other. In this way, the weld is connected by applying additional quartz glass along the edge and at the openings 31 in the cover plate, which lie opposite the spacers 23 for the cover plate. After completion of the weld, the openings in the cover plate are completely filled and also the edges between the top and bottom plate are filled so that there are no longer any gaps.

Then, the body is tempered under a vacuum or under a protective gas. The protective gas is fed directly into the body and flushes this body during the entire tempering process.

After the tempering, the surface is ground, polished, lapped, or sandblasted and then cleaned by acid. After this process, the top side is absolutely flat.

The interior of the radiator is either evacuated or filled with a protective gas and the radiator is sharpened.

The electrical contacts are attached on the outside.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An IR radiant heater comprising at least one planar carbon heating element (1) in a housing, the housing being at least partially transparent to IR radiation, wherein the at least one carbon heating element (1) is a carbon fiber-reinforced carbon web arranged in a plane and arranged between a first plate (2) and a second plate (3), at least one of the first plate (2) and second plate (3) being at least partially transparent to IR radiation.

2. The IR radiant heater according to claim 1, wherein the first plate (2) is reflective for IR radiation.

3. The IR radiant heater according to claim 2, wherein the IR reflective first plate (2) comprises opaque quartz glass.

4. The IR radiant heater according to claim 3, wherein the opaque quartz glass has a diffuse reflection of greater than about 90%.

5. The IR radiant heater according to claim 4, wherein the opaque quartz glass has a diffuse reflection of greater than about 95%.

6. The IR radiant heater according to claim 3, wherein the IR reflective first plate (2) comprising opaque quartz glass is a base plate welded or adhered or soldered to a transparent cover second plate (3).

7. The IR radiant heater according to claim 1, wherein the housing has a X spatial dimension, a Y spatial dimension, and a Z spatial dimension, and wherein the housing is more pronounced in the X and Y spatial dimensions than in the Z spatial dimension, at least by a factor of about five.

8. The IR radiant heater according to claim 7, wherein the housing is more pronounced in the X and Y spatial dimensions than in the Z spatial dimension, at least by about one to two orders of magnitude.

9. A method for producing an IR radiant heater having at least one planar carbon element (1) arranged in an at least partially IR radiation-transparent housing, comprising cutting the carbon heating element (1) from a planar carbon fiber-reinforced carbon material.

10. A method for producing an IR radiant heater having at least one carbon fiber-reinforced planar carbon element (1), comprising arranging the carbon fiber-reinforced planar carbon element (1) between a clear surface (3) and an opaque surface (2).

* * * * *